US008278254B2

(12) United States Patent
Devlin et al.

(10) Patent No.: US 8,278,254 B2
(45) Date of Patent: Oct. 2, 2012

(54) ADDITIVES AND LUBRICANT FORMULATIONS HAVING IMPROVED ANTIWEAR PROPERTIES

(75) Inventors: Mark T. Devlin, Richmond, VA (US); Kenneth J. Garelick, Mechanicsville, VA (US); Naresh C. Mathur, Midlothian, VA (US); Jeffrey M. Guevremont, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 1009 days.

(21) Appl. No.: 11/852,442

(22) Filed: Sep. 10, 2007

(65) Prior Publication Data

US 2009/0069205 A1 Mar. 12, 2009

(51) Int. Cl.
*C10M 139/00* (2006.01)
*C10M 141/12* (2006.01)

(52) U.S. Cl. ..... 508/371; 508/378; 508/463; 508/465; 508/486

(58) Field of Classification Search ..... 508/291, 508/108, 228, 391, 385, 539, 561
See application file for complete search history.

(56) References Cited

U.S. PATENT DOCUMENTS

| | | | | |
|---|---|---|---|---|
| 2,384,577 | A | 9/1945 | Thomas | |
| 2,710,872 | A | 6/1955 | Thompson | |
| 2,786,866 | A | 3/1957 | Hook et al. | |
| 2,897,152 | A | 7/1959 | Elliot et al. | |
| 3,017,361 | A * | 1/1962 | Morris et al. | 508/539 |
| 3,219,666 | A | 11/1965 | Norman et al. | |
| 3,356,702 | A | 12/1967 | Farmer et al. | |
| 3,407,222 | A | 10/1968 | Lies | |
| 3,509,051 | A | 4/1970 | Farmer et al. | |
| 3,565,804 | A | 2/1971 | Honnen et al. | |
| 3,697,574 | A | 10/1972 | Piasek et al. | |
| 3,736,357 | A | 5/1973 | Piasek et al. | |
| 3,794,081 | A | 2/1974 | Fiser et al. | |
| 3,867,359 | A | 2/1975 | Beadle | |
| 4,029,587 | A | 6/1977 | Koch | |
| 4,098,705 | A | 7/1978 | Sakuri et al. | |
| 4,164,473 | A | 8/1979 | Coupland et al. | |
| 4,178,258 | A | 12/1979 | Papay et al. | |
| 4,234,435 | A | 11/1980 | Meinhardt et al. | |
| 4,259,195 | A | 3/1981 | King et al. | |
| 4,261,843 | A | 4/1981 | King et al. | |
| 4,263,152 | A | 4/1981 | King et al. | |
| 4,265,773 | A | 5/1981 | deVries et al. | |
| 4,266,945 | A | 5/1981 | Karn | |
| 4,272,387 | A | 6/1981 | King et al. | |
| 4,283,295 | A | 8/1981 | deVries et al. | |
| 4,285,822 | A | 8/1981 | deVries et al. | |
| 4,362,633 | A | 12/1982 | Spence et al. | |
| 4,369,119 | A | 1/1983 | deVries et al. | |
| 4,395,343 | A | 7/1983 | deVries et al. | |
| 4,402,840 | A | 9/1983 | deVries et al. | |
| 4,466,901 | A | 8/1984 | Hunt et al. | |
| 4,636,322 | A | 1/1987 | Nalesnik | |
| 4,692,256 | A | 9/1987 | Umemura et al. | |
| 4,758,362 | A | 7/1988 | Butke | |
| 4,765,918 | A | 8/1988 | Love et al. | |
| 4,867,890 | A | 9/1989 | Colclough et al. | |
| 4,876,375 | A | 10/1989 | Lam | |
| 4,885,365 | A | 12/1989 | Lam | |
| 4,889,647 | A | 12/1989 | Rowan et al. | |
| 4,904,401 | A | 2/1990 | Ripple et al. | |
| 4,927,552 | A | 5/1990 | Lam | |
| 4,957,643 | A | 9/1990 | Lam | |
| 4,957,649 | A | 9/1990 | Ripple et al. | |
| 4,966,719 | A | 10/1990 | Coyle et al. | |
| 4,978,464 | A | 12/1990 | Coyle et al. | |
| 4,990,271 | A | 2/1991 | Francis | |
| 4,995,996 | A | 2/1991 | Coyle et al. | |
| 5,137,647 | A | 8/1992 | Karol | |
| 5,204,012 | A | 4/1993 | Schaffhausen | |
| 5,260,466 | A | 11/1993 | McGibbon | |
| 5,412,130 | A | 5/1995 | Karol | |
| 5,627,259 | A | 5/1997 | Thaler et al. | |
| 5,633,326 | A | 5/1997 | Patil et al. | |
| 5,643,859 | A | 7/1997 | Gutierrez et al. | |
| 5,652,201 | A * | 7/1997 | Papay et al. | 508/228 |
| 5,686,397 | A | 11/1997 | Baranski et al. | |
| 5,693,598 | A | 12/1997 | Abraham et al. | |
| 5,726,134 | A * | 3/1998 | Adams | 508/391 |
| 5,789,357 | A | 8/1998 | Baranski et al. | |
| 5,792,729 | A | 8/1998 | Harrison et al. | |
| 5,851,965 | A | 12/1998 | Harrison et al. | |
| 5,853,434 | A | 12/1998 | Harrison et al. | |
| 6,034,040 | A | 3/2000 | Ozbalik et al. | |
| 6,103,674 | A | 8/2000 | Nalesnik et al. | |
| 6,114,288 | A | 9/2000 | Fujitsu et al. | |
| 6,117,826 | A | 9/2000 | Baranski et al. | |
| 6,232,276 | B1 | 5/2001 | Stiefel et al. | |
| 6,268,316 | B1 * | 7/2001 | Tanaka et al. | 508/291 |
| 6,509,303 | B1 | 1/2003 | Gatto | |
| 6,528,463 | B1 | 3/2003 | Gatto et al. | |
| 6,599,865 | B1 | 7/2003 | Esche, Jr. et al. | |
| 6,797,677 | B2 | 9/2004 | Esche, Jr. et al. | |
| 7,439,213 | B2 * | 10/2008 | Tipton et al. | 508/561 |
| 2004/0266630 | A1 | 12/2004 | George et al. | |
| 2006/0210797 | A1 * | 9/2006 | Masuda et al. | 428/397 |

FOREIGN PATENT DOCUMENTS

| | | | |
|---|---|---|---|
| EP | 330522 | B1 | 8/1989 |
| JP | 2004149762 | A2 | 5/2004 |

* cited by examiner

*Primary Examiner* — Ellen McAvoy
*Assistant Examiner* — Chantel Graham
(74) *Attorney, Agent, or Firm* — Luedeka Neely Group, P.C.

(57) ABSTRACT

Lubricated surfaces, lubricant compositions for lubricating a surface, and methods for increasing antiwear properties in lubricants. The lubricated surface is provided by a lubricant composition including a base oil of lubricating viscosity, at least one metal salt of phosphorothioic acid, and an amount of at least one hydrocarbon soluble titanium compound effective to provide an increase in antiwear properties of the lubricant composition. A ratio of titanium metal to phosphorus in the antiwear agent ranges from about 0.3:1 to about 1.5:1.

23 Claims, No Drawings

ADDITIVES AND LUBRICANT FORMULATIONS HAVING IMPROVED ANTIWEAR PROPERTIES

TECHNICAL FIELD

The embodiments described herein relate to particular antiwear agent including an oil soluble titanium additive and a metal salt of phosphorothioic acid and use of such antiwear agent in lubricant oil formulations, and in particular to antiwear agents for lubricant formulations that provide a lubrication film thickness greater than a lubrication film thickness provided by a lubricant containing only one of the titanium additive and the metal salt of phosphorothioic acid.

BACKGROUND AND SUMMARY

Lubricating oils used in passenger cars and heavy duty diesel engines have changed over the years. Today's engines are designed to run hotter and harder than in the past. Various additives have been added to lubricant formulations in order to reduce wear between moving parts. One particularly common antiwear additive is a zinc dialkyl dithiophosphate ("ZnDDP"). While such zinc compounds are particularly useful as antiwear agents, such zinc compounds may have one or more of the following disadvantages: increased levels of sulfur and/or phosphorus in the finished lubricant.

Future generations of passenger car motor oils and heavy duty diesel engine oils require lower levels of phosphorus and sulfur in the finished oil in order to protect pollution control devices as it is well known that sulfur and phosphorus containing additives may poison or otherwise reduce the effectiveness of pollution control devices. For example, current GF-4 motor oil specifications require a finished oil to contain less than 0.08 wt % and 0.7 wt % phosphorus and sulfur, respectively, and PC-10 motor oil specifications, the next generation heavy duty diesel engine oil, requires oils to contain less than 0.12 wt % and 0.4 wt % phosphorus and sulfur, respectively, and 1.0 wt % sulfated ash. Certain antiwear additives known in the industry contain phosphorus and sulfur at levels which reduce the effectiveness of pollution control devices.

Therefore, a need exists for lubricant additives and compositions that provide enhanced antiwear properties and which are more compatible with pollution control devices used for automotive and diesel engines. A need also exists for such lubricant additives and compositions which are more compatible with such pollution control devices without adversely affecting oil solubility, corrosion, and/or darkening the color of the finished lubricant. Such additives may contain phosphorus and/or sulfur or may be substantially devoid of phosphorus and/or sulfur.

In one embodiment herein is presented a lubricated surface including a lubricant composition including a base oil of lubricating viscosity, at least one metal salt of phosphorothioic acid, and an amount of at least one hydrocarbon soluble titanium compound effective to provide an increase in antiwear properties of the lubricant composition wherein a ratio of titanium metal to phosphorus in the antiwear agent ranges from about 0.3:1 to about 1.5:1.

In another embodiment, there is provided a vehicle having moving parts and containing a lubricant for lubricating the moving parts. The lubricant includes an oil of lubricating viscosity, a friction modifier, and an antiwear agent comprising an amount of at least one hydrocarbon soluble titanium compound and an amount of at least one metal salt of phosphorothioic acid. A ratio of titanium metal to phosphorus in the antiwear agent ranges from about 0.3:1 to about 1.5:1. The antiwear agent provides a antiwear film thickness that is greater than a film thickness provided by the titanium compound or phosphorus compound alone.

In yet another embodiment there is provided a fully formulated lubricant composition including a base oil component of lubricating viscosity, and an antiwear agent comprising an amount of hydrocarbon soluble titanium-containing compound and an amount of at least one metal salt of phosphorothioic acid. A ratio of titanium metal to phosphorus in the antiwear agent ranges from about 0.3:1 to about 1.5:1.

A further embodiment of the disclosure provides a method for increasing an antiwear film thickness adjacent to a lubricated surface. The method includes contacting the surface with a lubricant composition comprising a base oil of lubricating viscosity and an amount of an antiwear agent comprising a hydrocarbon soluble titanium compound and a metal salt of phosphorothioic acid. The antiwear agent has a titanium metal to phosphorus ratio that provides a synergistic increase in the antiwear film thickness compared to an antiwear film thickness provided by a lubricant composition containing only one of the titanium compound and the metal salt of phosphorothioic acid.

As set forth briefly above, embodiments of the disclosure provide a combination of a hydrocarbon soluble titanium compound and a hydrocarbon soluble phosphoric acid metal salt that may significantly improve the antiwear properties of a lubricant composition and may enable a decrease in the amount of phosphorus and sulfur additives required for equivalent antiwear improving characteristics. The additive may be mixed with an oleaginous fluid that is applied to a surface between moving parts. In other applications, the additive may be provided in a fully formulated lubricant composition. The additive is particularly directed to meeting the currently proposed GF-4 standards for passenger car motor oils and PC-10 standards for heavy duty diesel engine oils, as well as future passenger car and diesel engine oil specifications and standards.

The compositions and methods described herein are particularly suitable for increasing a lubrication boundary layer between lubricated surfaces that is synergistically thicker than a boundary layer formed by a lubricant composition that is devoid of either the titanium compound or the phosphorus compound. Other features and advantages of the compositions and methods described herein may be evident by reference to the following detailed description which is intended to exemplify aspects of the embodiments without intending to limit the embodiments described herein.

It is to be understood that both the foregoing general description and the following detailed description are exemplary and explanatory only and are intended to provide further explanation of the embodiments disclosed and claimed.

DETAILED DESCRIPTION OF EMBODIMENTS

In one embodiment is presented a novel composition useful as a component in lubricating oil compositions. The composition comprises an antiwear agent that includes a hydrocarbon soluble titanium compound and a metal salt of phosphorothioic acid.

A first primary component of the antiwear agent for lubricant compositions is the hydrocarbon soluble titanium compound. The term "hydrocarbon soluble" means that the compound is substantially suspended or dissolved in a hydrocarbon material, as by reaction or complexation of a reactive titanium compound with a hydrocarbon material. As used herein, "hydrocarbon" means any of a vast number of compounds containing carbon, hydrogen, and/or oxygen in various combinations.

As used herein, the term "hydrocarbyl" refers to a group having a carbon atom attached to the remainder of the molecule and having predominantly hydrocarbon character. Examples of hydrocarbyl groups include:

a) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);
b) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);
c) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The hydrocarbon soluble titanium compounds suitable for use as a component of the antiwear agent are provided by a reaction product of a titanium alkoxide and a $C_6$ to $C_{25}$ carboxylic acid. The reaction product may be represented by the following formula:

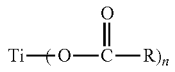

wherein n is an integer selected from 2, 3 and 4, and R is a hydrocarbyl group containing from about 5 to about 24 carbon atoms, or by the formula:

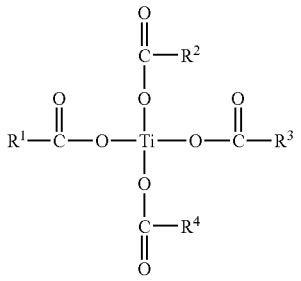

wherein each of $R^1$, $R^2$, $R^3$, and $R^4$ are the same or different and are selected from a hydrocarbyl group containing from about 5 to about 25 carbon atoms. Compounds of the foregoing formulas may be essentially devoid of phosphorous and sulfur.

In an embodiment, the hydrocarbon soluble titanium compound may be substantially or essentially devoid or free of sulfur and phosphorus atoms such that a lubricant or formulated lubricant package comprising the hydrocarbon soluble titanium compound contains about 0.7 wt % or less sulfur and about 0.12 wt % or less phosphorus.

In another embodiment, the hydrocarbon soluble titanium compound may be substantially free of active sulfur. "Active" sulfur is sulfur which is not fully oxidized. Active sulfur further oxidizes and becomes more acidic in the oil upon use.

In yet another embodiment, the hydrocarbon soluble titanium compound may be substantially free of all sulfur. In a further embodiment, the hydrocarbon soluble titanium compound may be substantially free of all phosphorus. In a still further embodiment, the hydrocarbon soluble titanium compound may be substantially free of all sulfur and phosphorus. For example, the base oil in which the titanium compound may be dissolved in could contain relatively small amounts of sulfur, such as in one embodiment, less than about 0.5 wt % and in another embodiment, about 0.03 wt % or less sulfur (e.g., for Group II base oils), and in a still further embodiment, the amount of sulfur and/or phosphorus may be limited to an amount which is necessary to make the compound while still permitting the finished oil to meet the appropriate motor oil sulfur and/or phosphorus specifications in effect at a given time.

Examples of titanium/carboxylic acid products include, but are not limited to, titanium reaction products with acids selected from the group consisting essentially of caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like. Methods for making such titanium/carboxylic acid products are described, for example, in U.S. Pat. No. 5,260,466, the disclosure of which is incorporated herein by reference.

Embodiments described herein provide lubricating oils and lubricant formulations in which the concentration of the hydrocarbon soluble titanium compound is relatively low, providing from about 1 to about 1500 parts per million (ppm) titanium in the finished lubricant composition. In one embodiment, the titanium compound is present in the lubricating oil compositions in an amount sufficient to provide from above about 25 to about 1000 ppm titanium.

A second primary component of the antiwear agent is the metal salt of phosphorothioic acid. Of the metal salts of phosphorithioic acid, a particularly suitable metal salt is zinc dihydrocarbyl dithiophosphate ("ZnDDP"). ZnDDPs have good antiwear and antioxidant properties. Many patents address the manufacture and use of ZnDDPs including U.S. Pat. Nos. 4,904,401; 4,957,649; and 6,114,288. Non-limiting general ZnDDP types are primary, secondary and mixtures of primary and secondary alkyl and aryl ZnDDPs. Examples of such compounds include, but are not limited to: zinc O,O-di ($C_{1-14}$-alkyl)dithiophosphate; zinc (mixed O,O-bis(sec-butyl and isooctyl))dithiophosphate; zinc-O,O-bis(branched and linear $C_{3-8}$-alkyl)dithiophosphate; zinc O,O-bis(2-ethylhexyl)dithiophosphate; zinc O,O-bis(mixed isobutyl and pentyl)dithiophosphate; zinc mixed O,O-bis(1,3-dimethylbutyl and isopropyl)dithiophosphate; zinc O,O-diisooctyl dithiophosphate; zinc O,O-dibutyl dithiophosphate; zinc mixed O,O-bis(2-ethylhexyl and isobutyl and isopropyl) dithiophosphate; zinc O,O-bis(dodecylphenyl)dithiophosphate; zinc O,O-diisodecyl dithiophosphate; zinc O-(6-methylheptyl)-O-(1-methylpropyl)dithiophosphate; zinc O-(2-ethylhexyl)-O-(isobutyl)dithiophosphate; zinc O,O-diisopropyl dithiophosphate; zinc (mixed hexyl and isopropyl)dithiophosphate; zinc (mixed O-(2-ethylhexyl) and O-isopropyl)dithiophosphate; zinc O,O-dioctyl dithiophosphate; zinc O,O-dipentyl dithiophosphate; zinc O-(2-methylbutyl)-O-(2-methylpropyl)dithiophosphate; and zinc O-(3-methylbutyl)-O-(2-methylpropyl)dithiophosphate.

The amount of phosphorus in the lubricant composition provided by the metal salt of phosphorothioic acid suitably ranges from about 100 to about 900 ppm phosphorus in the fully formulated lubricant composition. Other amounts of phosphorus in the lubricant composition may range from about 200 to about 500 ppm in the fully formulated lubricant composition. A particularly desirable antiwear agent has an amount of titanium compound and metal salt of phosphorothioic acid sufficient to provide a ratio of titanium to phosphorus of from about 0.3:1 to about 1.5:1 in the antiwear agent.

The antiwear agents of the embodiments described herein are advantageously incorporated into lubricating compositions. Accordingly, the antiwear agent may be added directly to the lubricating oil composition. In one embodiment, however, the antiwear agent is diluted with a substantially inert, normally liquid organic diluent such as mineral oil, synthetic oil (e.g., ester of dicarboxylic acid), naptha, alkylated (e.g., $C_{10}$-$C_{13}$ alkyl)benzene, toluene or xylene to form an antiwear additive concentrate. The antiwear concentrates usually contain from about 0% to about 99% by weight diluent oil.

In the preparation of lubricating oil formulations it is common practice to introduce the antiwear concentrates in the form of about 1 to about 99 wt. % active ingredient concentrates in hydrocarbon oil, e.g. mineral lubricating oil, or other suitable solvent. Usually these concentrates may be added to a lubricating oil with a dispersant/inhibitor (DI) additive package and viscosity index (VI) improvers containing about 0.01 to about 50 parts by weight of lubricating oil per part by weight of the DI package to form finished lubricants, e.g., crankcase motor oils. Suitable DI packages are described, for example, in U.S. Pat. Nos. 5,204,012 and 6,034,040, the disclosures of which are herein incorporated by reference. Among the types of additives which may be included in the DI additive package are detergents, dispersants, friction modifiers, seal swell agents, antioxidants, foam inhibitors, lubricity agents, rust inhibitors, corrosion inhibitors, demulsifiers, pour point depressants, viscosity index improvers, and the like. Several of these components are well known to those skilled in the art and may be used in conventional amounts with the additives and compositions described herein.

The additives are typically blended into the base oil in an amount that enables that additive to provide its desired function. Representative effective amounts of the antiwear agent and additives, when used in crankcase lubricants, are listed in Table 1 below. All the values listed are stated as weight percent active ingredient.

TABLE 1

| Component | Wt. % (Broad) | Wt. % (Typical) |
|---|---|---|
| Dispersant | 0.5-10.0 | 1.0-5.0 |
| Antioxidant system | 0-5.0 | 0.01-3.0 |
| Metal Detergents | 0.1-15.0 | 0.2-8.0 |
| Corrosion Inhibitor | 0-5.0 | 0-2.0 |
| Metal dihydrocarbyl dithiophosphate | 0.1-6.0 | 0.1-4.0 |
| Ash-free amine phosphate salt | 0.1-6.0 | 0.1-4.0 |
| Antifoaming agent | 0-5.0 | 0.001-0.15 |
| Titanium Compound | 0-5.0 | 0-2.0 |
| Supplemental antiwear agents | 0-1.0 | 0-0.8 |
| Pour point depressant | 0.01-5.0 | 0.01-1.5 |
| Viscosity modifier | 0.01-20.00 | 0.25-10.0 |

TABLE 1-continued

| Component | Wt. % (Broad) | Wt. % (Typical) |
|---|---|---|
| Supplemental friction modifier | 0-2.0 | 0.1-1.0 |
| Base oil | Balance | Balance |
| Total | 100 | 100 |

In another embodiment, the antiwear concentrates may be top treated into a fully formulated motor oil or finished lubricant. The purpose of combining the antiwear concentrates and DI package, of course, is to make the handling of the various materials less difficult and awkward as well as to facilitate solution or dispersion in the final blend.

Lubricant compositions made with the antiwear agent described above are used in a wide variety of applications. For compression ignition engines and spark ignition engines, it is preferred that the lubricant compositions meet or exceed published GF-4 or API-CI-4 standards. Lubricant compositions according to the foregoing GF-4 or API-CI-4 standards include a base oil, the DI additive package, and/or a VI improver to provide a fully formulated lubricant. The base oil for lubricants according to the disclosure is an oil of lubricating viscosity selected from the group consisting essentially of mineral oils, synthetic lubricating oils, vegetable oils and mixtures thereof. Such base oils include those conventionally employed as crankcase lubricating oils for spark-ignited and compression-ignited internal combustion engines, such as automobile and truck engines, marine and railroad diesel engines, and the like. Such base oils are typically classified as Group I, Group II, Group III, Group IV and Group V, as described in Table 2 below.

TABLE 2

| Group I-V Base Oils | | | | |
|---|---|---|---|---|
| Base Oil | % Sulfur | | % Saturates | Viscosity Index |
| Group I | >0.03 | and/or | <90 | 80-120 |
| Group II | ≦0.03 | and/or | ≧90 | 80-120 |
| Group III | ≦0.03 | and/or | ≧90 | ≧120 |
| Group IV | * | | | |
| Group V | ** | | | |

* Group IV base oils are defined as all polyalphaolefins

** Group V base oils are defined as all other base oils not included in Groups I, II, III and IV and may include gas to liquid base oils.

Dispersant Components

Dispersants contained in the DI package may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described, for example, in U.S. Pat. Nos. 3,697,574 and 3,736,357; ashless succcinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

Oxidation Inhibitor Components

Oxidation inhibitors, or antioxidants, reduce the tendency of base stocks to deteriorate in service, which deterioration can be evidenced by the products of oxidation such as sludge and varnish-like deposits that deposit on metal surfaces and by viscosity growth of the finished lubricant. Such oxidation inhibitors include, but are not limited to, hindered phenols, sulfurized hindered phenols, alkaline earth metal salts of alkylphenolthioesters having about $C_5$ to about $C_{12}$ alkyl side chains, sulfurized alkylphenols, metal salts of either sulfurized or nonsulfurized alkylphenols, for example calcium nonylphenol sulfide, ashless oil soluble phenates and sulfurized phenates, phosphosulfurized or sulfurized hydrocarbons, phosphorus esters, metal thiocarbamates, and oil soluble copper compounds as described in U.S. Pat. No. 4,867,890.

Other antioxidants that may be used include sterically hindered phenols and diarylamines, alkylated phenothiazines, sulfurized compounds, and ashless dialkyldithiocarbamates. Non-limiting examples of sterically hindered phenols include, but are not limited to, 2,6-di-tertiary butylphenol, 2,6 di-tertiary butyl methylphenol, 4-ethyl-2,6-di-tertiary butylphenol, 4-propyl-2,6-di-tertiary butylphenol, 4-butyl-2,6-di-tertiary butylphenol, 4-pentyl-2,6-di-tertiary butylphenol, 4-hexyl-2,6-di-tertiary butylphenol, 4-heptyl-2,6-di-tertiary butylphenol, 4-(2-ethylhexyl)-2,6-di-tertiary butylphenol, 4-octyl-2,6-di-tertiary butylphenol, 4-nonyl-2,6-di-tertiary butylphenol, 4-decyl-2,6-di-tertiary butylphenol, 4-undecyl-2,6-di-tertiary butylphenol, 4-dodecyl-2,6-di-tertiary butylphenol, methylene bridged sterically hindered phenols including, but not limited to, 4,4-methylenebis(6-tert-butyl-o-cresol), 4,4-methylenebis(2-tert-amyl-o-cresol), 2,2-methylenebis(4-methyl-6 tert-butylphenol, 4,4-methylene-bis(2,6-di-tert-butylphenol) and mixtures thereof as described in U.S. Publication No. 2004/0266630.

Diarylamine antioxidants include, but are not limited, to diarylamines having the formula:

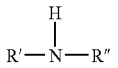

wherein R' and R" each independently represents a substituted or unsubstituted aryl group having from about 6 to about 30 carbon atoms. Illustrative of substituents for the aryl group include, but are not limited to, aliphatic hydrocarbon groups such as alkyl group having from about 1 to about 30 carbon atoms, hydroxy groups, halogen radicals, carboxylic acid or ester groups, or nitro groups.

The aryl group may be a substituted or unsubstituted phenyl or naphthyl. In one embodiment, one or both of the aryl groups are substituted with at least one alkyl group having from about 4 to about 30 carbon atoms. In another embodiment, one or both of the aryl groups are substituted with at least one alkyl group having from about 4 to about 18 carbon atoms. In yet another embodiment, one or both of the aryl groups are substituted with at least one alkyl group having from about 4 to about 9 carbon atoms. In still yet another embodiment, one or both of the aryl groups are substituted, e.g. mono-alkylated diphenylamine, di-alkylated diphenylamine, or mixtures of mono- and di-alkylated diphenylamines.

The diarylamines may be of a structure containing more than one nitrogen atom in the molecule. Thus, the diarylamine may contain at least two nitrogen atoms wherein at least one nitrogen atom has two aryl groups attached thereto, e.g., as in the case of various diamines having a secondary nitrogen atom as well as two aryls on one of the nitrogen atoms.

Examples of diarylamines that may be used include, but are not limited to: diphenylamine; various alkylated diphenylamines; 3-hydroxydiphenylamine; N-phenyl-1,2-phenylenediamine; N-phenyl-1,4-phenylenediamine; monobutyldiphenyl-amine; dibutyldiphenylamine; monooctyldiphenylamine; dioctyldiphenylamine; monononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyl-diphenylamine; p-oriented styrenated diphenylamine; mixed butyloctyldi-phenylamine; and mixed octylstyryldiphenylamine.

Another class of aminic antioxidants includes phenothiazine or alkylated phenothiazine having the chemical formula:

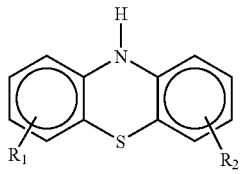

wherein $R_1$ is a linear or branched about $C_1$ to about $C_{24}$ alkyl, aryl, heteroalkyl or alkylaryl group and $R_2$ is hydrogen or a linear or branched about $C_1$- about $C_{24}$ alkyl, heteroalkyl, or alkylaryl group. Alkylated phenothiazine may be selected from the group consisting essentially of monotetradecylphenothiazine, ditetradecylphenothiazine, monodecylphenothiazine, didecylphenothiazine, monononylphenothiazine, dinonylphenothiazine, monoctyl-phenothiazine, dioctylphenothiazine, monobutylphenothiazine, dibutylphenothiazine, monostyrylphenothiazine, distyrylphenothiazine, butyloctylphenothiazine, and styryloctylphenothiazine.

The sulfur containing antioxidants include, but are not limited to, sulfurized olefins that are characterized by the type of olefin used in their production and the final sulfur content of the antioxidant. In one embodiment, high molecular weight olefins, i.e. those olefins having an average molecular weight of about 168 to about 351 g/mole, may be used. Non-limiting examples of olefins that may be used include alpha-olefins, isomerized alpha-olefins, branched olefins, cyclic olefins, and combinations of these.

Alpha-olefins include, but are not limited to, any about $C_4$ to about $C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soyabean oil, sunflower seed oil, tallow, and combinations of these.

The amount of sulfurized olefin or sulfurized fatty oil delivered to the finished lubricant is based on the sulfur content of the sulfurized olefin or fatty oil and the desired level of sulfur to be delivered to the finished lubricant. For example, a sulfurized fatty oil or olefin containing about 20 weight % sulfur, when added to the finished lubricant at an approximately 1.0 weight % treat level, will deliver 2,000 ppm of sulfur to the finished lubricant. A sulfurized fatty oil or olefin containing about 10 weight % sulfur, when added to the finished lubricant at an approximately 1.0 weight % treat level, will deliver 1,000 ppm sulfur to the finished lubricant. In one embodiment, the sulfurized olefin or sulfurized fatty oil is added to deliver between about 200 ppm and about 2,000 ppm sulfur to the finished lubricant. The foregoing aminic, phenothiazine, and sulfur containing antioxidants are described, for example, in U.S. Pat. No. 6,599,865.

The ashless dialkyldithiocarbamates which may be used as antioxidant additives include, but are not limited to, compounds that are soluble or dispersable in the additive package. In one embodiment, the ashless dialkyldithiocarbamate may be of low volatility, and may have a molecular weight greater than about 250 Daltons. In yet another embodiment, the ashless dialkyldithiocarbamate may a molecular weight greater than about 400 Daltons. Examples of ashless dithiocarbamates that may be used include, but are not limited to, methylenebis(dialkyldithiocarbamate), ethylenebis(dialkyldithiocarbamate), isobutyl disulfide-2,2'-bis(dialkyldithiocarbamate), hydroxyalkyl substituted dialkyldithio-carbamates, dithiocarbamates prepared from unsaturated compounds, dithiocarbamates prepared from norbornylene, and dithiocarbamates prepared from epoxides. In an embodiment, the alkyl groups of the dialkyldithiocarbamate may have from about 1 to about 16 carbons. Non-limiting examples of dialkyldithiocarbamates that may be used are disclosed in the following patents: U.S. Pat. Nos. 5,693,598; 4,876,375; 4,927,552; 4,957,643; 4,885,365; 5,789,357; 5,686,397; 5,902,776; 2,786,866; 2,710,872; 2,384,577; 2,897,152; 3,407,222; 3,867,359; and 4,758,362.

Further examples of ashless dithiocarbamates may include, but are not limited to: methylenebis-(dibutyldithiocarbamate), ethylenebis(dibutyl-dithiocarbamate), isobutyl disulfide-2,2'-bis(dibutyldithiocarbamate), dibutyl-N,N-dibutyl-(dithiocar-bamyl)succinate, 2-hydroxypropyl dibutyldithiocarbamate, Butyl(dibutyldithio-carbamyl)acetate, and S-carbomethoxy-ethyl-N,N-dibutyl dithiocarbamate.

Likewise, organomolybdenum containing compounds used as friction modifiers may also exhibit antioxidant and antiwear functionality. U.S. Pat. No. 6,797,677 describes a combination of organomolybdenum compound, alkylphenothizine and alkyldiphenylamines for use in finished lubricant formulations. Non-limiting examples of suitable molybdenum containing friction modifiers are described below under "Friction Modifier Components".

The antiwear agents described herein may be used with any or all of the foregoing antioxidants in any and all combinations and ratios. It is understood that various combinations of phenolic, aminic, sulfur containing and molybdenum containing additives may be optimized for the finished lubricant formulation based on bench or engine tests or modifications of the dispersant, VI improver, base oil, or any other additive.

Friction Modifier Components

A sulfur- and phosphorus-free organomolybdenum compound that may be used as a friction modifier may be prepared by reacting a sulfur- and phosphorus-free molybdenum source with an organic compound containing amino and/or alcohol groups. Non-limiting examples of sulfur- and phosphorus-free molybdenum sources include molybdenum trioxide, ammonium molybdate, sodium molybdate and potassium molybdate. The amino groups may include, but are not limited to, monoamines, diamines, or polyamines. The alcohol groups may include, but are not limited to, mono-substituted alcohols, diols or bis-alcohols, or polyalcohols. As an example, the reaction of diamines with fatty oils produces a product containing both amino and alcohol groups that can react with the sulfur- and phosphorus-free molybdenum source.

Non-limiting examples of sulfur- and phosphorus-free organomolybdenum compounds include the following:

1. Compounds prepared by reacting certain basic nitrogen compounds with a molybdenum source as described in U.S. Pat. Nos. 4,259,195 and 4,261,843.

2. Compounds prepared by reacting a hydrocarbyl substituted hydroxy alkylated amine with a molybdenum source as described in U.S. Pat. No. 4,164,473.

3. Compounds prepared by reacting a phenol aldehyde condensation product, a mono-alkylated alkylene diamine, and a molybdenum source as described in U.S. Pat. No. 4,266,945.

4. Compounds prepared by reacting a fatty oil, diethanolamine, and a molybdenum source as described in U.S. Pat. No. 4,889,647.

5. Compounds prepared by reacting a fatty oil or acid with 2-(2-aminoethyl)aminoethanol, and a molybdenum source as described in U.S. Pat. No. 5,137,647.

6. Compounds prepared by reacting a secondary amine with a molybdenum source as described in U.S. Pat. No. 4,692,256.

7. Compounds prepared by reacting a diol, diamino, or amino-alcohol compound with a molybdenum source as described in U.S. Pat. No. 5,412,130.

8. Compounds prepared by reacting a fatty oil, mono-alkylated alkylene diamine, and a molybdenum source as described in U.S. Pat. No. 6,509,303.

9. Compounds prepared by reacting a fatty acid, mono-alkylated alkylene diamine, glycerides, and a molybdenum source as described in U.S. Pat. No. 6,528,463.

Molybdenum compounds prepared by reacting a fatty oil, diethanolamine, and a molybdenum source as described in U.S. Pat. No. 4,889,647 are sometimes illustrated with the following structure, where R is a fatty alkyl chain, although the exact chemical composition of these materials is not fully known and may in fact be multi-component mixtures of several organomolybdenum compounds.

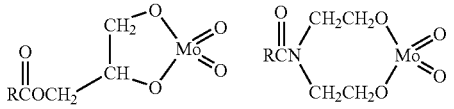

Sulfur-containing organomolybdenum compounds may be used and may be prepared by a variety of methods. One method involves reacting a sulfur and phosphorus-free molybdenum source with an amino group and one or more sulfur sources. Sulfur sources can include for example, but are not limited to, carbon disulfide, hydrogen sulfide, sodium sulfide and elemental sulfur. Alternatively, the sulfur-containing molybdenum compound may be prepared by reacting a sulfur-containing molybdenum source with an amino group or thiuram group and optionally a second sulfur source. Examples of sulfur- and phosphorus-free molybdenum sources include molybdenum trioxide, ammonium molybdate, sodium molybdate, potassium molybdate, and molybdenum halides. The amino groups may be monoamines, diamines, or polyamines. As an example, the reaction of molybdenum trioxide with a secondary amine and carbon disulfide produces molybdenum dithiocarbamates. Alternatively, the reaction of $(NH_4)_2Mo_3S_{13}*n(H_2O)$ where n varies between 0 and 2, with a tetralkylthiuram disulfide, produces a trinuclear sulfur-containing molybdenum dithiocarbamate.

Examples of sulfur-containing organomolybdenum compounds appearing in patents and patent applications include the following:

1. Compounds prepared by reacting molybdenum trioxide with a secondary amine and carbon disulfide as described in U.S. Pat. Nos. 3,509,051 and 3,356,702.

2. Compounds prepared by reacting a sulfur-free molybdenum source with a secondary amine, carbon disulfide, and an additional sulfur source as described in U.S. Pat. No. 4,098,705.

3. Compounds prepared by reacting a molybdenum halide with a secondary amine and carbon disulfide as described in U.S. Pat. No. 4,178,258.

4. Compounds prepared by reacting a molybdenum source with a basic nitrogen compound and a sulfur source as described in U.S. Pat. Nos. 4,263,152, 4,265,773, 4,272,387, 4,285,822, 4,369,119, and 4,395,343.

5. Compounds prepared by reacting ammonium tetrathiomolybdate with a basic nitrogen compound as described in U.S. Pat. No. 4,283,295.

6. Compounds prepared by reacting an olefin, sulfur, an amine and a molybdenum source as described in U.S. Pat. No. 4,362,633.

7. Compounds prepared by reacting ammonium tetrathiomolybdate with a basic nitrogen compound and an organic sulfur source as described in U.S. Pat. No. 4,402,840.

8. Compounds prepared by reacting a phenolic compound, an amine and a molybdenum source with a sulfur source as described in U.S. Pat. No. 4,466,901.

9. Compounds prepared by reacting a triglyceride, a basic nitrogen compound, a molybdenum source, and a sulfur source as described in U.S. Pat. No. 4,765,918.

10. Compounds prepared by reacting alkali metal alkylthioxanthate salts with molybdenum halides as described in U.S. Pat. No. 4,966,719.

11. Compounds prepared by reacting a tetralkylthiuram disulfide with molybdenum hexacarbonyl as described in U.S. Pat. No. 4,978,464.

12. Compounds prepared by reacting an alkyl dixanthogen with molybdenum hexacarbonyl as described in U.S. Pat. No. 4,990,271.

13. Compounds prepared by reacting alkali metal alkylxanthate salts with dimolybdenum tetra-acetate as described in U.S. Pat. No. 4,995,996.

14. Compounds prepared by reacting $(NH_4)_2Mo_3S_{13}*2H_2O$ with an alkali metal dialkyldithiocarbamate or tetralkyl thiuram disulfide as described in U.S. Pat. No. 6,232,276.

15. Compounds prepared by reacting an ester or acid with a diamine, a molybdenum source and carbon disulfide as described in U.S. Pat. No. 6,103,674.

16. Compounds prepared by reacting an alkali metal dialkyldithiocarbamate with 3-chloropropionic acid, followed by molybdenum trioxide, as described in U.S. Pat. No. 6,117,826.

Molybdenum dithiocarbamates may be illustrated by the following structure,

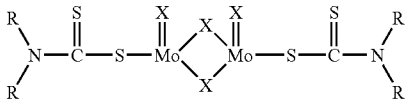

where R is an alkyl group containing about 4 to about 18 carbons or H, and X is O or S.

Glycerides may also be used alone or in combination with other friction modifiers. Suitable glycerides include, but are not limited to, glycerides of the formula:

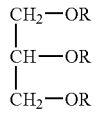

wherein each R is independently selected from the group consisting of H and C(O)R' where R' may be a saturated or an unsaturated alkyl group having from about 3 to about 23 carbon atoms. Non-limiting examples of glycerides that may be used include glycerol monolaurate, glycerol monomyristate, glycerol monopalmitate, glycerol monostearate, and mono-glycerides derived from coconut acid, tallow acid, oleic acid, linoleic acid, and linolenic acids. Typical commercial monoglycerides contain substantial amounts of the corresponding diglycerides and triglycerides. These materials are not detrimental to the production of the molybdenum compounds, and may in fact be more active. Any ratio of mono- to di-glyceride may be used. In an embodiment, from about 30% to about 70% of the available sites contain free hydroxyl groups (i.e., 30% to 70% of the total R groups of the glycerides represented by the above formula are hydrogen). In another embodiment, the glyceride is glycerol monooleate, which is generally a mixture of mono, di, and tri-glycerides derived from oleic acid, and glycerol.

Other Components

Rust inhibitors selected from the group consisting essentially of nonionic polyoxyalkylene polyols and esters thereof, polyoxyalkylene phenols, and anionic alkyl sulfonic acids may be used.

A small amount of a demulsifying component may be used. A preferred demulsifying component is described in EP Pat. No. 330,522, the disclosure of which is herein incorporated by reference. Such demulsifying component may be obtained by reacting an alkylene oxide with an adduct obtained by reacting a bis-epoxide with a polyhydric alcohol. The demulsifier should be used at a level not exceeding 0.1 mass % active ingredient. In an embodiment, a treat rate of about 0.001 to about 0.05 mass % active ingredient may be used.

Pour point depressants, otherwise known as lube oil flow improvers, lower the minimum temperature at which the fluid will flow or can be poured. Such additives are well known. Non-limiting examples of pour point depressant additives which improve the low temperature fluidity of the fluid are about $C_8$ to about $C_{18}$ dialkyl fumarate/vinyl acetate copolymers, polyalkylmethacrylates and the like.

Foam control can be provided by many compounds including, but not limited to, an antifoamant of the polysiloxane type, for example, silicone oil or polydimethyl siloxane.

Seal swell agents, as described, but not limited to, for example, in U.S. Pat. Nos. 3,794,081 and 4,029,587, may also be used.

Viscosity modifiers (VM) function to impart high and low temperature operability to a lubricating oil. The VM used may have that sole function, or may be multifunctional.

Multifunctional viscosity modifiers that also function as dispersants are also known. Non-limiting examples of suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Functionalized olefin copolymers that may also be used include interpolymers of ethylene and propylene which are grafted with an active monomer such as maleic anhydride and then derivatized with an alcohol or amine. Other such copolymers are copolymers of ethylene and propylene which are grafted with nitrogen compounds.

Each of the foregoing additives, when used, is used at a functionally effective amount to impart the desired properties to the lubricant. Thus, for example, if an additive is a corrosion inhibitor, a functionally effective amount of this corrosion inhibitor would be an amount sufficient to impart the desired corrosion inhibition characteristics to the lubricant. Generally, the concentration of each of these additives, when used, ranges up to about 20% by weight based on the weight of the lubricating oil composition, and in one embodiment from about 0.001% to about 20% by weight, and in one embodiment about 0.01% to about 10% by weight based on the weight of the lubricating oil composition.

The antiwear agent may be added directly to the lubricating oil composition. In one embodiment, however, the antiwear agent is diluted with a substantially inert, normally liquid organic diluent such as mineral oil, synthetic oil, naphtha, alkylated (e.g. $C_{10}$ to $C_{13}$ alkyl) benzene, toluene or xylene to form an additive concentrate. These concentrates usually contain from about 1% to about 100% by weight and in one embodiment about 10% to about 90% by weight of the antiwear agent.

Base Oils

Base oils suitable for use in formulating the compositions, additives and concentrates described herein may be selected from any of the synthetic, natural and mineral oils, or mixtures thereof. Non-limiting examples of synthetic base oils include alkyl esters of dicarboxylic acids, polyglycols and alcohols, poly-alpha-olefins, including polybutenes, alkyl benzenes, organic esters of phosphoric acids, polysilicone oils, and alkylene oxide polymers, interpolymers, copolymers and derivatives thereof where the terminal hydroxyl groups have been modified by esterification, etherification, and the like.

Natural base oils include, but are not limited to, animal oils and vegetable oils (e.g., castor oil, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. In an embodiment, the base oil typically has a viscosity of about 2.5 to about 15 cSt. In another embodiment, the base oil has a viscosity of about 2.5 to about 11 cSt at 100° C. Such base oils include those conventionally employed as crankcase lubricating oils for spark-ignited and compression-ignited internal combustion engines, such as automobile and truck engines, marine and railroad diesel engines, and the like. These base oils are typically classified as Group I, Group II, Group III, Group IV and Group V. The above mentioned base oils are described above in Table 1.

The following examples are given for the purpose of exemplifying aspects of the embodiments and are not intended to limit the embodiments in any way.

EXAMPLE 1

Neodecanoic acid (about 600 grams) was placed into a reaction vessel equipped with a condenser, Dean-Stark trap, thermometer, thermocouple, and a gas inlet. Nitrogen gas was bubbled into the acid. Titanium isopropoxide (about 245 grams) was slowly added to the reaction vessel with vigorous stirring. The reactants were heated to about 140° C. and stirred for one hour. Overheads and condensate from the reaction were collected in the trap. A subatmospheric pressure was applied to the reaction vessel and the reactants were stirred for about an additional two hours until the reaction was complete. Analysis of the product indicated that the product had a kinematic viscosity of about 14.3 cSt at about 100° C. and a titanium content of about 6.4 percent by weight.

EXAMPLE 2

Neodecanoic acid (about 240.3 grams) and Oleic acid (about 126.9 grams) were placed into a reaction vessel equipped with a distillation condenser, thermometer, thermocouple, and a gas inlet. Nitrogen gas was bubbled into the acid mixture. Titanium isopropoxide (about 152 grams) was slowly added to the reaction vessel with vigorous stirring. The reactants were heated to about 60° C. and stirred for about 30 min. A subatmospheric pressure of about 15 inches was applied to the reaction vessel and the temperature was gradually ramped to about 14° C. approx. 4 hrs. The product was then stripped under vacuum. The product thus obtained had titanium content of about 7.2 percent by weight.

EXAMPLE 3

In the following example, lubricant compositions were formulated with titanium compound of Example 2 and ZnDDP and film formation properties were measured using a PCS mini-traction machine (MTM) with a spacer-layer imaging (SLIM) attachment (hereinafter referred to as "MTMSLIM"). In the MTM, a rolling-sliding contact is generated between a steel ball and a steel disk operating at a mean rolling speed of 0.1 μm/sec. and a slide-roll-ratio of 50%. Tests were performed at 100° C. with an applied load of about 1.0 GPa between the ball and the disk. The tests were run for 60 minutes each. The following table contains the results of the MTMSLIM tests on a number of antiwear agent formulations.

TABLE 3

| Sample No. | Ti Compound (wt. %) | ZDDP (wt. %) | Ti (ppm) | P (ppm) | Ti/P ratio | MTMSLIM nm at 60 min |
|---|---|---|---|---|---|---|
| 1 | 0.00 | 1.00 | 0 | 800 | N/A | 45 |
| 2 | 0.00 | 0.75 | 0 | 600 | N/A | 63 |
| 3 | 0.00 | 0.50 | 0 | 400 | N/A | 117 |
| 4 | 0.00 | 0.10 | 0 | 80 | N/A | 80 |
| 5 | 1.00 | 0.00 | 722 | 0 | N/A | 9 |
| 6 | 0.75 | 0.00 | 542 | 0 | N/A | 3 |
| 7 | 0.50 | 0.00 | 361 | 0 | N/A | 2 |
| 8 | 0.32 | 0.00 | 231 | 0 | N/A | 2 |
| 9 | 0.32 | 0.75 | 231 | 600 | 0.39 | 124 |
| 10 | 0.50 | 1.00 | 361 | 800 | 0.45 | 152 |
| 11 | 0.32 | 0.50 | 231 | 400 | 0.58 | 148 |
| 12 | 0.75 | 0.75 | 542 | 600 | 0.90 | 129 |
| 13 | 0.50 | 0.50 | 361 | 400 | 0.90 | 143 |
| 14 | 0.32 | 0.25 | 231 | 200 | 1.16 | 141 |
| 15 | 0.75 | 0.50 | 542 | 400 | 1.35 | 138 |
| 16 | 1.00 | 0.50 | 722 | 400 | 1.81 | 73 |
| 17 | 0.32 | 0.10 | 231 | 80 | 2.89 | 9 |

As shown by the foregoing results, a combination of the titanium compound and ZnDDP has a synergistic effect on the lubricating film layer thickness. For example, Samples 1-4 containing from 80 to 800 ppm phosphorus and no titanium had film thicknesses ranging from 45 to 117 nm for an average of about 76 nm. Samples 5-8 containing from 231 to 722 ppm titanium and no phosphorus had film layer thicknesses ranging from about 2 to 9 nm for an average of about 4 nm. Accordingly, the arithmetic average of an antiwear agent containing about 200 to about 700 ppm titanium and from about 80 to about 800 ppm phosphorus is expected to be about 80 nm. However, as shown by Samples 9-15, the actual film layer thicknesses ranged from 124 to 152 nm. Hence, there is a synergistic increase in the film layer thickness when a combination of titanium compound and ZnDDP are used as the antiwear agent.

The results further indicate there may be a desirable ratio of titanium to phosphorus in the antiwear agent that provides superior results. In Samples 9-15, the ratio ranges from 0.39:1 to about 1.35:1. As shown by Samples 16 and 17, ratios much above 1.25 provide film layer thicknesses comparable to the thicknesses provided by antiwear agents devoid of either the titanium compound or the phosphorus compound.

It is expected that lubricant formulation containing from about 1 to about 1000 ppm or more titanium metal in the form of a hydrocarbon soluble titanium compound may enable a reduction in conventional phosphorus and sulfur antiwear compounds by providing a synergistic increase in the film layer thickness with the phosphorus and sulfur containing antiwear compound thereby maintaining the effectiveness the performance of pollution control equipment on vehicles while achieving a improved antiwear properties or benefits.

At numerous places throughout this specification, reference has been made to a number of U.S. Patents and publications. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A lubricated surface comprising a lubricant composition including a base oil of lubricating viscosity, at least one metal salt of phosphorothioic acid, and an amount of at least one hydrocarbon soluble titanium compound comprising a reaction product of a titanium alkoxide and a carboxylic acid selected from the group consisting of a non-linear carboxylic acid and a carboxylic acid having more than 22 up to 25 carbon atoms, said titanium compounds being effective to provide an increase in antiwear properties of the lubricant composition wherein a weight ratio of titanium metal provided by the hydrocarbon soluble titanium compound to phosphorus in the antiwear agent ranges from about 0.3:1 to about 1.5:1.

2. The lubricated surface of claim 1, wherein the lubricated surface comprises and engine drive train.

3. The lubricated surface of claim 1, wherein the lubricated surface comprises an internal surface or component of an engine selected from the group consisting of an internal combustion engine and a compression ignition engine.

4. The lubricated surface of claim 1, wherein the amount of hydrocarbon soluble titanium compound provides an amount of titanium ranging from about 10 ppm to about 1000 ppm in the lubricant composition.

5. The lubricated surface of claim 1, wherein the amount of hydrocarbon soluble titanium compound provides an amount of titanium ranging from about 50 ppm to about 800 ppm in the lubricant composition.

6. The lubricated surface of claim 1, wherein the hydrocarbon soluble titanium compound is substantially devoid of phosphorus and sulfur atoms.

7. The lubricated surface of claim 1, wherein the carboxylic acid comprises a mono-carboxylic acid containing at least about 6 carbon atoms and having a secondary, or tertiary carbon adjacent to a carboxyl group.

8. The lubricated surface of claim 1, wherein metal salt of phosphorothioic acid comprises zinc dihydrocarbyl dithiophosphate.

9. The lubricated surface of claim 1, wherein the lubricant composition comprises from about 200 to about 500 ppm phosphorus.

10. A vehicle having moving parts and containing a lubricant for lubricating the moving parts, the lubricant comprising an oil of lubricating viscosity, a friction modifier, and an antiwear agent comprising an amount of at least one hydrocarbon soluble titanium compound comprising a reaction product of a titanium alkoxide and a carboxylic acid selected from the group consisting of a non-linear carboxylic acid and a carboxylic acid having more than 22 up to 25 carbon atoms, and an amount of at least one metal salt of phosphorothioic acid, wherein a weight ratio of titanium metal provided by the hydrocarbon soluble titanium compound to phosphorus in the antiwear agent ranges from about 0.3:1 to about 1.5:1 and the antiwear agent provides a antiwear film thickness that is greater than a film thickness provided by the titanium compound or phosphorus compound alone.

11. The vehicle of claim 10, wherein the weight ratio of titanium metal to phosphorus in the antiwear agent ranges from about 0.5:1 to about 1.45:1.

12. The vehicle of claim 10, wherein the moving parts comprise a heavy duty diesel engine.

13. The vehicle of claim 10, wherein the lubricant composition comprises from about 100 to about 900 ppm phosphorus.

14. A fully formulated lubricant composition comprising a base oil component of lubricating viscosity, and an antiwear agent comprising an amount of hydrocarbon soluble titanium-containing compound comprising a reaction product of a titanium alkoxide and a carboxylic acid selected from the group consisting of a non-linear carboxylic acid and a carboxylic acid having more than 22 up to 25 carbon atoms, and an amount of at least one metal salt of phosphorothioic acid, wherein a weight ratio of titanium metal provided by the hydrocarbon soluble titanium compound to phosphorus in the antiwear agent ranges from about 0.3:1 to about 1.5:1.

15. The fully formulated lubricant composition of claim 14, wherein the weight ratio of titanium metal to phosphorus in the antiwear agent ranges from about 0.5:1 to about 1.45:1.

16. The fully formulated lubricant composition of claim 14, wherein the lubricant composition comprises from about 10 to about 1000 ppm titanium.

17. The lubricant composition of claim 14 wherein the lubricant composition comprises a low ash, low sulfur, and low phosphorus lubricant composition suitable for compression ignition engines such that the finished oil contains about 0.7 wt % or less sulfur and about 0.1 wt % or less phosphorus.

18. A method for increasing an antiwear film thickness adjacent to a lubricated surface, comprising contacting the surface with a lubricant composition comprising a base oil of lubricating viscosity and an amount of an antiwear agent comprising a hydrocarbon soluble titanium compound comprising a reaction product of a titanium alkoxide and a carboxylic acid selected from the group consisting of a non-linear carboxylic acid and a carboxylic acid having more than 22 up to 25 carbon atoms, and a metal salt of phosphorothioic acid, wherein the antiwear agent has a titanium metal to phosphorus ratio by weight that provides a synergistic increase in the antiwear film thickness compared to an antiwear film thickness provided by a lubricant composition containing only one of the titanium compound and the metal salt of phosphorothioic acid.

19. The method of claim 18, wherein the weight ratio of titanium metal provided by the hydrocarbon soluble titanium compound to phosphorus in the antiwear agent comprises from about 0.3:1 to about 1.5:1.

20. The method of claim 18, wherein the lubricant composition further comprises a friction modifier selected from the group consisting essentially of an organomolybdenum friction modifier, a glycerol ester friction modifier, and a mixture thereof.

21. An additive concentrate for a lubricant composition comprising an antiwear agent including at least one metal salt of phosphorothioic acid, and an amount of at least one hydrocarbon soluble titanium compound comprising a reaction product of a titanium alkoxide and a carboxylic acid selected from the group consisting of a non-linear carboxylic acid and a carboxylic acid having more than 22 up to 25 carbon atoms, said titanium compounds being effective to provide an increase in antiwear properties of the lubricant composition, wherein a weight ratio of titanium metal provided by the hydrocarbon soluble titanium compound to phosphorus in the antiwear agent ranges from about 0.3:1 to about 1.5:1.

22. The additive concentrate of claim 21, wherein the amount of hydrocarbon soluble titanium compound provides an amount of titanium ranging from about 50 ppm to about 800 ppm in the lubricant composition.

23. The additive concentrate of claim 21, wherein an amount of the metal salt of phosphorothioic acid in the additive concentrate is sufficient to provide the lubricant composition with from about 100 to about 900 ppm phosphorus.

* * * * *